United States Patent [19]

Taniguchi

[11] Patent Number: 4,913,975

[45] Date of Patent: Apr. 3, 1990

[54] FLAME-RETARDANT ELECTROTHERMAL TRANSFER RECORDING MEDIUM

[75] Inventor: Makoto Taniguchi, Nagano, Japan

[73] Assignee: Seiko Epson Corporation, Tokyo, Japan

[21] Appl. No.: 149,324

[22] Filed: Jan. 28, 1988

[30] Foreign Application Priority Data

Jan. 29, 1987 [JP] Japan ..... 62-19147

[51] Int. Cl.[4] ..... B41M 5/26

[52] U.S. Cl. ..... 428/480; 428/195; 428/206; 428/207; 428/408; 428/913; 428/914

[58] Field of Search ..... 428/195, 206, 207, 484, 428/488.1, 488, 913, 914, 323, 408, 480

[56] References Cited

U.S. PATENT DOCUMENTS 3,956,231 5/1976 Moore et al. ..... 523/205

4,073,772 2/1978 Anderson ..... 524/373

*Primary Examiner*—Bruce H. Hess

*Assistant Examiner*—D. R. Schwartz

*Attorney, Agent, or Firm*—Blum Kaplan

[57] ABSTRACT

An electrothermal transfer recording medium formed with a support layer, a flameproof electrothermal resistive layer on one side of the support and an ink layer on the opposite side of the support is provided. The flameproof electrothermal resistive layer includes carbon black and a brominated aromatic compound with at least two aromatic rings dispersed therein. As used herein, the term "brominated aromatic compound" includes brominated aromatic compounds and polymers, derivatives and mixtures thereof. The brominated aromatic compounds having at least two aromatic rings are flameproofing agents, improve dispersability of carbon black, are readily micronizable and function to micronize particles of other flame retardants or flame retardants assistants added to the resistive layer.

13 Claims, 1 Drawing Sheet

FLAME-RETARDANT ELECTROTHERMAL TRANSFER RECORDING MEDIUM

BACKGROUND OF THE INVENTION

This invention relates generally to electrothermal transfer recording media including an ink layer on one side of a substrate and an electrothermal resistive layer on the opposite side, and in particular, to an electrothermal transfer recording medium wherein the electrothermal resistive layer includes a brominated flameproofing material Electrothermal transfer recording or printing is popular in many fields such as facsimile devices, computer terminal equipment and recorders because numerous benefits over other types of recording are obtained. The benefits include non-impact noiseless recording, minimal maintenance, low cost, reduced size, reduced weight and adaptability to multi-color printing. Most importantly, electrothermal transfer printing using an electrothermal transfer recording head is suitable for production of half tones in full-color printing and is a promising approach to production of hard copies.

FIG. 1 is a diagram illustrating the principle of operation of electrothermal transfer recording. An electrothermal transfer recording medium 101 is formed of a support layer 203 with an electrothermal resistive layer 202 on one side and an ink layer 204 on the opposite side. Resistive layer 202 has carbon black dispersed therein to impart electrical conductivity. A recording head 104 selectively applies an electric current to resistive layer 202 by a recording electrode 102 and a return electrode 103.

Electrothermal transfer recording onto a recording sheet 205 is accomplished by pressing recording electrode 102 against electrothermal resistive layer 202 to start current flow through and accumulate Joulean heat in resistive layer 202 until an elevated temperature is reached. The elevated temperature in resistive layer 202 causes substrate 203 to conduct heat to ink layer 204. As a result, ink layer 204 is heated, melted and flows onto recording sheet 205.

The most important requirements for resistive layers are generally considered to be:

(1) a resistance value between about $10^2$ and $5\times10^5$ ohms;

(2) heat-resistance for a short period of time at a temperature of at least 300° C.; and (3) sufficient adhesion between the resistive layer and the substrate to dissipate the effect of shear friction caused by the forced contact of the resistive layer with the recording head.

To meet these requirements, a resistive layer including a resin binder and carbon black having a DBP oil absorption capacity of at leat 300 ml/100 g is disclosed and claimed in U.S. Pat. No. 4,684,563 issued on Aug. 4, 1987 to the named inventors herein.

Recently, it has become important to flameproof recording media to prevent spontaneous combustion and improve safety. Generally available flameproofing techniques require addition of a halogenated organic compound which functions as a flame retardant and an antimony oxide series compound which functions as a flame retardant assistant to a substance requiring flameproofing. However, it is difficult to disperse the necessary carbon black when these substances are added to electrothermal resistive layers. Furthermore, the halogenated organic flame retardant is not readily micronized when used in combination with resistive layers containing carbon black and therefore flameproofing properties are not imparted efficiently.

For example, when tetrabromophthalic anhydride; hexabromobenzene; or 1,2,3,4,7,8,9,10,13,13,14,14-dodecachloro-1,4,4a,5,6,6a,7,10,10a,11,12,12a-dodecahydro-1,4,7,10-dimethanodibenzo (a, e) cyclooctene (hereinafter referred to as "Dechlo"), all of which are effective flameproofing agents, are dispersed with carbon black, the dispersibility of the carbon black decreases and previously dispersed carbon black tends to flocculate and cannot be micronized. These phenomena have prevented development of flameproof electrothermal resistive layers with stable resistance values. Known resistive layers also generally have rough surfaces.

Accordingly, it is desirable to provide an electrothermal transfer recording medium having a flameproof resistive layer with a micronized flame retardant and evenly dispersed carbon black.

SUMMARY OF THE INVENTION

Generally speaking, in accordance with the invention, an electrothermal transfer recording medium formed with a support layer, a flameproof electrothermal resistive layer on one side and an ink layer on the opposite side is provided. The flameproof electrothermal resistive layer includes evenly dispersed carbon black and a brominated aromatic compound having at least two aromatic rings. As used herein, the term "brominated aromatic compound" includes brominated aromatic compounds and polymers, derivatives and mixtures thereof. Brominated aromatic compounds having at least two aromatic rings have been found to be effective flameproofing agents, improve dispersability of carbon black, be readily micronizable and function to micronize particles of other flame retardants or flame retardants assistants added to the resistive layer.

Accordingly, it is an object of the invention to provide an improved electrothermal transfer recording medium having a flameproof electrothermal resistive layer.

Another object of the invention is to provide an improved electrothermal recording medium having a flameproof electrothermal resistive layer including carbon black and at lease one brominated aromatic compound including at least two aromatic rings.

A further object of the invention is to provide an improved electrothermal transfer recording medium having a flameproof electrothermal resistive layer wherein carbon black is micronized and dispersed without flocculation so that the resistance value is stable over an extended period of time.

Still another object of the invention is to provide an improved electrothermal transfer recording medium having a flame-proof electrothermal resistive layer having micronized brominated aromatic flame retardants and flame retardant assistants.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
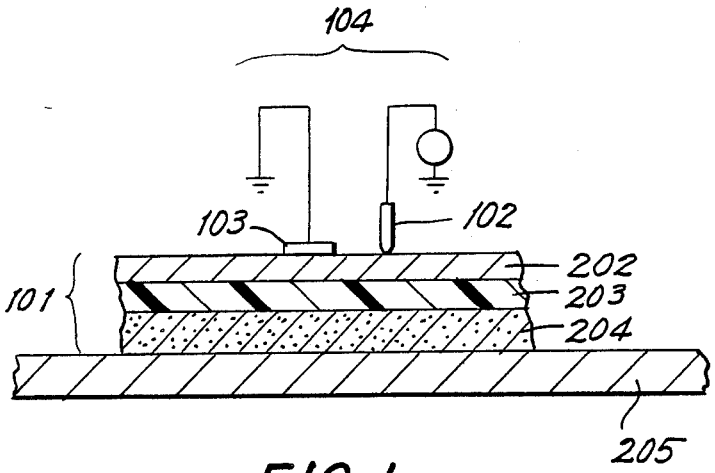
FIG. 1 is a diagram showing the principle of operation of the electrothermal transfer recording medium in accordance with the invention.
Figure 2:
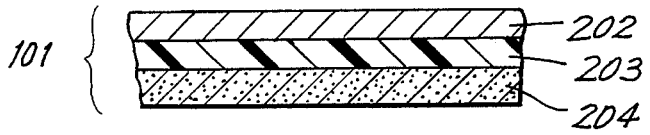
FIG. 2 is a cross-section of an electrothermal transfer recording medium constructed and arranged in accordance with the invention.

Brominated aromatic compounds, polymers of brominated aromatic compounds, brominated aromatic compound derivatives and mixtures thereof are known flame retardants. When brominated aromatic compounds having at least two aromatic rings are incorporated into an electrothermal resistive layer of an electrothermal transfer recording medium, the dispersability of carbon black is improved, the brominated aromatic compounds can be micronized and the ability to micronize particles of other flame retardants is enhanced. Accordingly, use of brominated aromatic compounds including at least two aromatic rings as flame retardant provides unexpected advantages.

The brominated aromatic compounds having at least two aromatic rings are included in the electrothermal resistive layer in an amount between about 1 and 40% by weight. One or more of the brominated aromatic compounds can be used. The electrothermal resistive layer can also include conductive carbon black particles, a resin such as a polyester resin and a flame retardant assistant such as antimony trioxide.

The invention will be better understood with reference to the following Examples. These Examples are presented for purposes of illustration only and are not intended to be construed in a limiting sense.

Examples 1–16 and Comparative Examples 1–7

Electrothermal resistive layers having the compositions shown in Table 1 were prepared in accordance with the invention.

TABLE 1

| | Examples 1–16 | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| carbon black | 20 | 20 | 20 | 20 | 20 | 20 | 20 | 20 | 20 | 20 | 20 | 20 | 20 | 20 | 20 | 20 |
| polyester | 30 | 30 | 30 | 30 | 30 | 30 | 30 | 30 | 30 | 30 | 30 | 30 | 30 | 30 | 30 | 30 |
| flame retardant assistant | 10 | 10 | 10 | 10 | 10 | 10 | 10 | 10 | 10 | 10 | 10 | 10 | 10 | 10 | 10 | 10 |
| flame retardant | | | | | | | | | | | | | | | | |
| A | 40 | | | | 1 | 1 | 1 | | | | | | | | | |
| B | | 40 | | | | | | 1 | 1 | 1 | | | | | | |
| C | | | 40 | | | | | | | | 1 | 1 | 1 | | | |
| D | | | | 40 | | | | | | | | | | 1 | 1 | 1 |
| e | | | | | 39 | | | 39 | | | 39 | | | 39 | | |
| f | | | | | | 39 | | | 39 | | | 39 | | | 39 | |
| g | | | | | | | 39 | | | 39 | | | 39 | | | 39 |

Electrothermal resistive layers having the compositions shown in Table 2 were prepared for purposes of comparison.

TABLE 2

| | Comparative Examples 1–7 | | | | | | |
|---|---|---|---|---|---|---|---|
| | 1 | 2 | 3 | 4 | 5 | 6 | 7 |
| carbon black | 20 | 20 | 20 | 20 | 20 | 20 | 20 |
| polyester | 30 | 30 | 30 | 25 | 25 | 25 | 25 |

TABLE 2-continued

| | Comparative Examples 1–7 | | | | | | |
|---|---|---|---|---|---|---|---|
| | 1 | 2 | 3 | 4 | 5 | 6 | 7 |
| flame retardant assistant | 10 | 10 | 10 | 10 | 10 | 10 | 10 |
| flame retardant | | | | | | | |
| A | | | | 45 | | | |
| B | | | | | 45 | | |
| C | | | | | | 45 | |
| D | | | | | | | 45 |
| e | 40 | | | | | | |
| f | | 40 | | | | | |
| g | | | 40 | | | | |

The resistive layer components shown in Tables 1 and 2 were as follows:

carbon black: conductive particles, XC-72 a product of Cabot Corporation.

polyester: Vital Series, a product of Goodyear Corporation flame retardant assistant: antimony trioxide, a product of Nippon Seiko Kabushiki Kaisha flame retardant A: poly-(2,6-dibromophenyleneoxide)

B: decabromodiphenylether

C: decabromodiphenoxy ethane

D: brominated polystyrene e: tetrabromophthalic anhydride f: hexabromobenzene g: Dechlo Flame retardants A, B, C and D each have two or more aromatic rings in accordance with the invention; flame retardants e, f and g do not have two or more aromatic rings.

The samples were prepared by dissolving the polyester resin in equal parts of toluene, methyl ethyl ketone and cyclohexanone. The carbon black, flame retardant and flame retardant assistant were added and dispersed for twelve hours in a sample bottle filled with glass beads. The concentration of solid components was maintained at about 15% by weight.

The dispersability of carbon black in the resistive layer was evaluated by coating the liquid electrothermal resistive material on a glass slide and observing the samples through a microscope. The number of flocculated or non-dispersed carbon black particles within a 0.1 $mm^2$ area was counted and recorded. Five samples were tested for each Example and Comparative Example. The average value of each of the five samples was calculated and the results are shown in Table 3.

TABLE 3

| Results of Examples 1-16 | | | | | | | | | | | | | | | |
|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 |
| ◎ | ◎ | ◎ | ◎ | ◎ | ◎ | ◎ | ◎ | ◎ | ◎ | ◎ | ◎ | ◎ | ◎ | ◎ | ◎ |

| Results of Comparative Examples 1-7 | | | | | | |
|---|---|---|---|---|---|---|
| 1 | 2 | 3 | 4 | 5 | 6 | 7 |
| X | X | X | Δ | Δ | Δ | Δ |

◎ = an average value of less than 1
○ = an average value of 1 or more and less than 5
Δ = an average value of 5 or more and less than 10
X = an average value of 10 or greater As can be seen, between about 1 and 40 parts by weight of brominated aromatic compounds or brominated phenols and their polymers having at least two aromatic rings were effective for imparting dispersibility to the carbon black. When 45 or more parts by weight of the brominated aromatic compound or brominated phenol having at least two aromatic rings were used, flocculation occurred indicating that the carbon black was non-dispersable.

Micronization of the flame retardant particles was evaluated by a method similar to that for evaluating carbon black dispersability. An electrothermal resistive liquid was spread on a glass sample slide and observed through a microscope. The number of particles having a diameter of at least 2 $\mu$m in a 0.1 $mm^2$ area was counted. Five samples were tested for each Example and Comparative Example. The average value of the five samples was evaluated and the results are shown in Table 4.

TABLE 4

| Results of Examples 1-16 | | | | | | | | | | | | | | | |
|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 |
| ◎ | ◎ | ◎ | ◎ | ○ | ○ | ○ | ○ | ○ | ○ | ○ | ○ | ○ | ○ | ○ | ○ |

| Results of Comparative Examples 1-7 | | | | | | |
|---|---|---|---|---|---|---|
| 1 | 2 | 3 | 4 | 5 | 6 | 7 |
| X | X | X | ◎ | ◎ | ◎ | ◎ |

◎ = an average value of less than 10
○ = an average value of 10 or more and less than 50
Δ = an average value of 50 or more and less than 100
X = an average value of 100 or more As can be seen from Tables 1, 2 and 4, a brominated aromatic compound or brominated phenol and polymers thereof having at least two aromatic rings in the electrothermal resistive layer was helpful for obtaining micronization of flame retardant particles. Furthermore, substantially the same result is achieved when the electrothermal resistive layers prepared in accordance with the invention were used in an electrothermal transfer recording medium.

Flame retardants of brominated aromatic compounds or brominated phenols and their polymers having at least two aromatic rings effectively prevent flocculation of carbon black and micronize particles of other flame retardants. This effect is not observed using prior art flame retardants.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. An electrothermal transfer recording sheet, comprising:

a support layer;

a current-passing resistance layer integrally bound to the support layer on one surface thereof, said resistance layer including carbon black dispersed evenly therein, and a brominated aromatic compound having at least two aromatic rings; and an ink layer integrally bound to the opposed surface of the support layer.

2. The electrothermal transfer recording sheet of claim 1, wherein the brominated aromatic compound is selected from the group consisting of a polymer of a brominated aromatic compound, a brominated aromatic compound derivative having at least two aromatic rings and mixtures thereof.

3. The electrothermal transfer recording sheet of claim 1, wherein the brominated aromatic compound is present in amount between about 1 and 40 parts by weight.

4. The electrothermal transfer recording sheet of claim 1, wherein the brominated aromatic compound is poly-(2,6-dibromophenyleneoxide).

5. The electrothermal transfer recording sheet of claim 1, wherein the brominated aromatic compound is decabromodiphenylether.

6. The electrothermal transfer recording sheet of claim 1, wherein the brominated aromatic compound is decabromodiphenoxy ethane.

7. The electrothermal transfer recording sheet of claim 1, wherein the brominated aromatic compound is brominated polystyrene.

8. The electrothermal transfer recording sheet of claim 1, wherein the carbon black is used in an amount between about 5 and 35 parts by weight.

9. The electrothermal transfer recording sheet of claim 1, wherein the electrothermal resistive layer further includes a polyester resin in an amount between about 20 and 60 parts by weight.

10. The electrothermal transfer recording sheet of claim 1, wherein the electrothermal resistive layer further includes antimony trioxide in an amount between about 1 and 15 parts by weight.

11. The electrothermal transfer recording sheet of claim 1, wherein the resistive layer includes between about 1 and 40 parts by weight of the brominated aromatic hydrocarbon, 5 and 35 parts by weight carbon black and 20 and 60 parts by weight polyester resin binder.

12. The electrothermal transfer recording sheet of claim 1, wherein the electrothermal resistive layer further includes a flame retardant assistant in an amount between about 1 and 15 parts by weight.

13. The electrothermal transfer recording sheet of claim 1, wherein the brominated aromatic compound has the structure:

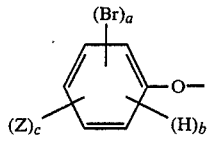
wherein a is an integer from 1 to 4, b is an integer from 0 to 3, c is an integer from 0 to 4, and a+b+c is equal to 5, Br represents a bromine atom bonded with a carbon atom of an aromatic ring, H is a hydrogen atom bonded with a carbon atom of an aromatic ring and Z is an oxygen atom bonded with a carbon atom of an aromatic ring and with a carbon atom of a second aromatic ring.
* * * * *